United States Patent [19]

Brown

[11] Patent Number: 4,943,117

[45] Date of Patent: Jul. 24, 1990

[54] BODY WEIGHT DISTRIBUTION SUPPORT CHAIR

[76] Inventor: Shawn W. Brown, 11590 Lazy Valley Rd., Penn Valley, Calif. 95946

[21] Appl. No.: 383,545

[22] Filed: Jul. 24, 1989

[51] Int. Cl.[5] ..... A47C 1/10

[52] U.S. Cl. ..... 297/392; 297/195; 297/423; 297/411

[58] Field of Search ..... 297/392, 411, 426, 423, 297/446, 461, 195, 391, 428, 429; 248/118, 118.1, 188.1, 188.8

[56] References Cited

U.S. PATENT DOCUMENTS

| | | | |
|---|---|---|---|
| 1,199,976 | 10/1916 | Fertig et al. | 297/428 |
| 2,154,606 | 4/1939 | Covington | 297/195 |
| 2,195,632 | 4/1960 | Reum et al. | 297/446 X |
| 3,708,201 | 1/1973 | Lamkemeyer | 297/195 X |
| 4,607,882 | 8/1986 | Opsvik | 297/195 |
| 4,650,249 | 3/1987 | Serber | 297/423 X |
| 4,662,361 | 5/1987 | Patterson | 297/195 X |
| 4,690,459 | 9/1987 | Ullman | 297/423 X |
| 4,746,167 | 5/1988 | Palmer et al. | 297/394 X |

FOREIGN PATENT DOCUMENTS

| | | | |
|---|---|---|---|
| 3541120 | 5/1987 | Fed. Rep. of Germany | 297/423 |
| 8500275 | 1/1985 | PCT Int'l Appl. | 297/423 |

*Primary Examiner*—Jose V. Chen

*Attorney, Agent, or Firm*—Mark C. Jacobs

[57] ABSTRACT

A chair for computer users, sculptors, electronic assembly line workers and others wherein the weight of the body of the user is concentrated between the ankles and knee by permitting the chair user to position his or her body somewhat forwardly, while providing the ability to utilize the hands freely but in a non-fatigue inducing position.

The user sits in the chair, facing the back. The chair features a split back portion to enable the user to see what he is working upon; a pair of diverging arm supports emanating from a back support; and diverging ankle supports emanating from the main superstructure.

19 Claims, 5 Drawing Sheets

BODY WEIGHT DISTRIBUTION SUPPORT CHAIR

FIELD OF INVENTION

This invention pertains to chairs for computer users, sculptors, artists, and other workers who use their hands over an extended period of time but who do not want to stand while working.

BACKGROUND OF THE INVENTION

There are currently available in the marketplace stools for use by computer users wherein the body's weight is distributed onto the femur area. The computer operator leans forwardly and keystrokes for the period of time he or she desires or needs to. While such stools are beneficial, they have limited utility in that they require the user to sit fairly low, and they do not provide any support for the chest or the arms. Thus they are totally unsuited for artists, or sculptors who generally work in a standing position rather than seated.

On the other hand, assembly line workers, who work in elevated seats, almost resembling bar stools have no support for their arms, even though they work seated. Some of these bar stool type seats do offer a rung for the soles of the feet, but not all.

There is a need therefore, for a seat that is capable of distributing the body weight, but which likewise support the arms of the user such that tasks can be performed without fatigue.

It is an object of this invention to provide an elevated seat that distributes the body weight of the user.

It is another object to provide a chair wherein the user's arms are free to move a bit to perform tasks, yet the arms remain supported to thereby prevent fatigue.

Yet another object is to provide a chair wherein the user's leg weight is supported to thereby reduce the danger of the oncoming of varicose veins.

Other objects of the invention will in part be obvious and will in part appear hereinafter.

The invention accordingly comprises the apparatus possessing the construction, combination of elements and arrangement of parts which are exemplified in the following detailed disclosure, and the scope of the application of which will be indicated in the appended claims.

For a fuller understanding of the nature and objects of the invention, reference should be had to the following detailed description taken in connection with the accompanying drawings.

SUMMARY OF THE INVENTION

A comfort chair that distributes the user's body weight while supporting both the arms and the legs and permits the user to perform tasks over extended periods of time without tiring. A superstructure has a seat portion mounted thereto spaced from a back portion. The back portion has a pair of diverging arm supports mounted thereto. The superstructure also includes a pair of spaced opposed knee supports positioned upwardly from a pair of opposed spaced sole or ankle supports.

DESCRIPTION OF THE PREFERRED EMBODIMENT

Figure 1:
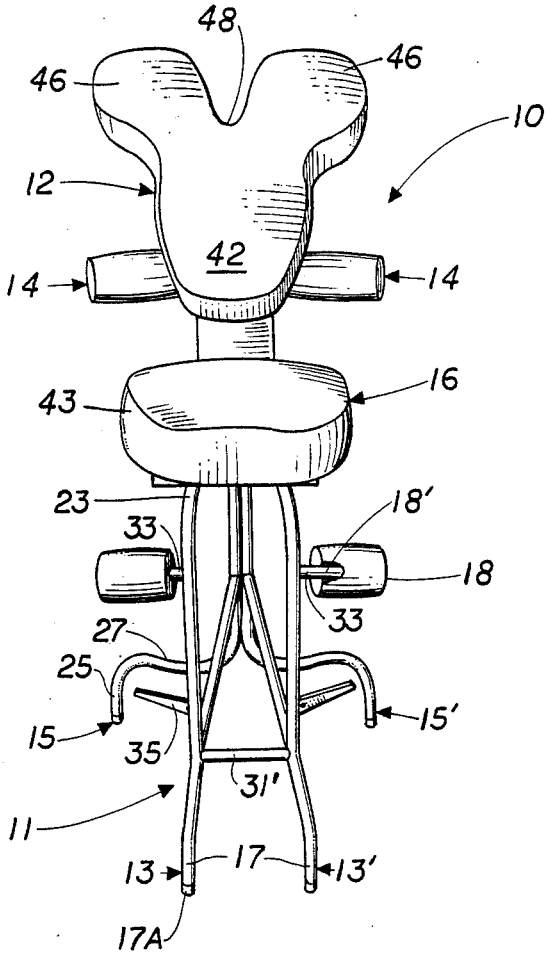
FIG. 1 is a front perspective view of the comfort chair of this invention.
Figure 2:
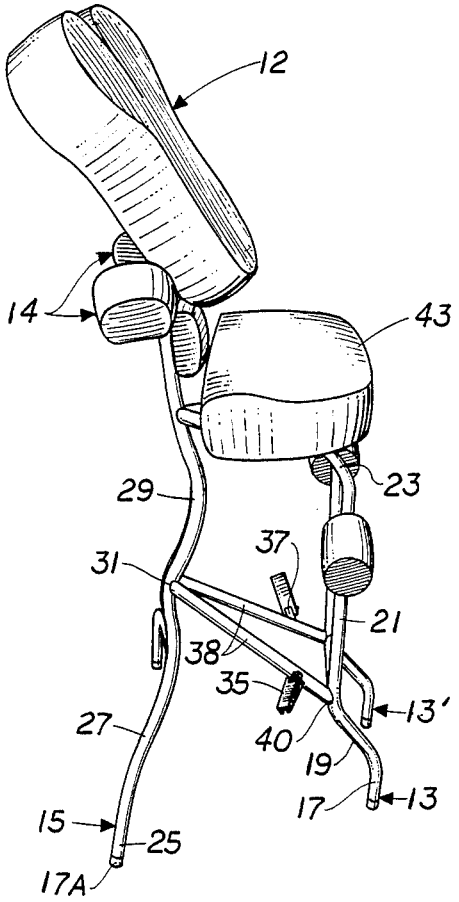
FIG. 2 is a left side perspective view thereof.

The comfort chair 10 of this invention is shown best in FIGS. 1 and 2. Chair 10, has a superstructure 11 that supports a seat portion 16, and a head-chest portion 12 spaced from said seat portion but attached to the superstructure.

The superstructure 11 is comprised of a plurality of interconnected tubes which may be of about 1" in diameter and may be made of metal; such as, painted steel, mill finish or anodized aluminum or chromium plated steel; or plastic such as ABS (acrylonitrile-butadiene-styrene), polyvinyl chloride, or even polycarbonate.

Figure 11:
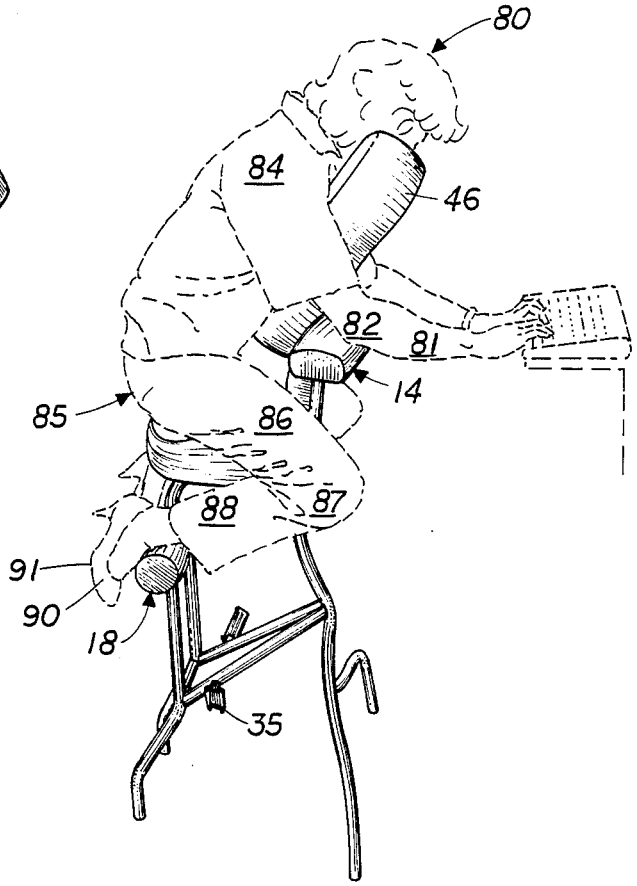
FIG. 11 is a view similar to FIG. 10, but showing the presence of a user in the chair, with her knees being supported.
Figure 12:
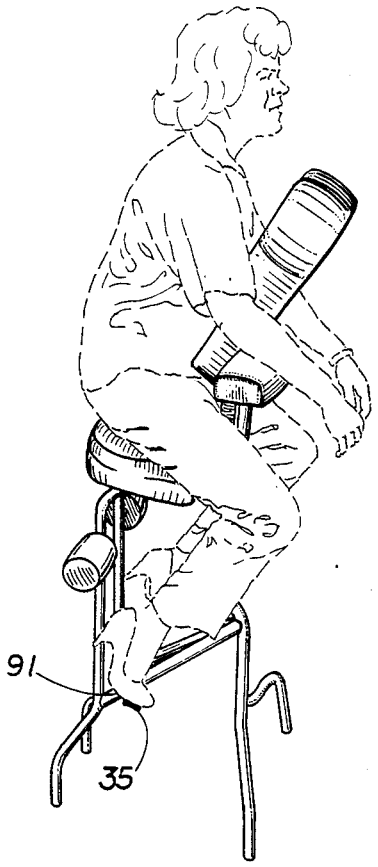
FIG. 12 is a view similar to FIG. 11 , wherein the user's soles are supported rather than the knees.

In view of the unique preferred mode of use of the instant chair, the reader is referred first to FIGS. 11 and 12. Thus this chair which features a head-chest portion 12, is seen to be backless, the description of the parts will follow normal convention however, and as is seen by reference to FIG. 1, legs 13, 13' are deemed the front legs with legs 15, 15' being the rear legs.

The superstructure features a pair of spaced front legs, 13, 13' and spaced rear legs 15, 15'. Front legs 13, 13' as is seen in FIG. 2 include a generally vertical base section 17, which is integrally connected at one end to an upwardly inclined second section 19, which is in turn integrally connected to a generally vertical third section 21, which in turn is integrally connected to a curved seat joiner tube 23, seen in both FIGS. 1 and 5. Between legs 13, 13' is a horizontal bar 31' joining the two legs.

Inclined second sections 19 may diverge outwardly slightly as shown in FIG. 1. Base section 17 optionally may include a conventional rubber foot 17A as a tube closure at the bottom thereof. The seat joiner 23 terminates at the seat support 24 shown in FIG. 5.

Figure 4:
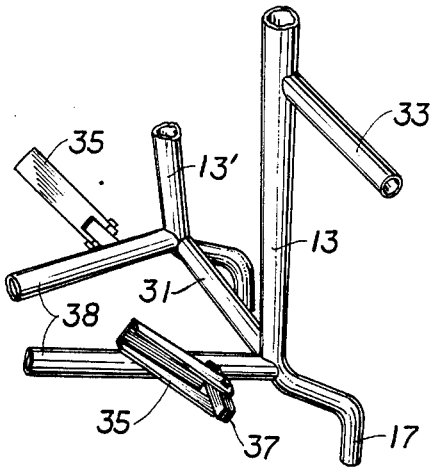
FIG. 4 is a perspective view of a portion of the superstructure.

The rear legs 15, 15' also include a plurality of integrated or interconnected tubes. These too may also have conventional rubber feet as tube closures for the first sections 25 thereof. First sections 25 are generally vertical tubes spaced from each other and disposed further apart than the spaced base sections of the front legs 13 and 13', in order to enhance stability of the comfort chair. Connected integrally to each first section is an inwardly directed S-curved second section 27, which has a vertically directed third section 29 connected at the opposite end thereof. These two third sections almost abut and may be connected to each other for further support as by welding if they are metallic or by adhesion if plastic. For the purpose of aesthetic design, vertical third section 29 may have some bend in it as shown in FIG. 2. As is seen in FIGS. 2 and 4, a pair of rearwardly converging upwardly directed connecting posts 38 connect the front legs 13, 13' to the rear legs 15, 15'. Post 38 attaches to the front legs at junction 40 and to the rear legs at junction 31.

Figure 3:
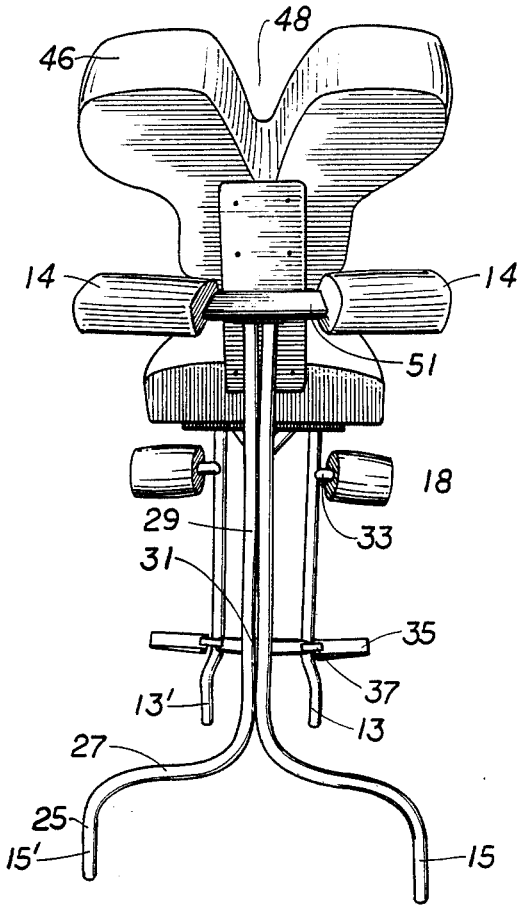
FIG. 3 is a rear perspective view of the apparatus of this invention.

Disposed along the elevation vertical third sections 21 of the front legs, at the same suitable location are a pair of leg bars 33. See FIG. 1 and 3. Disposed upon these leg bars 33 are rests 18. These rests are preferably cylindrical upholstered padded members having a central bore 18' therein for the disposition of the leg bars 33.

Figure 9:
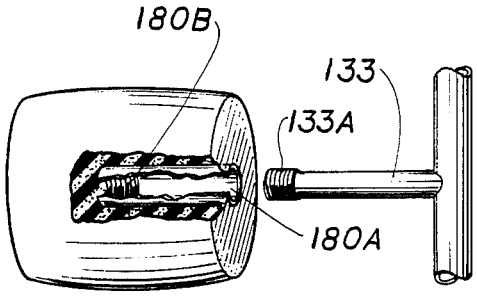
FIG. 9 is a closeup perspective view of a variant of an aspect of this invention.
Figure 10:
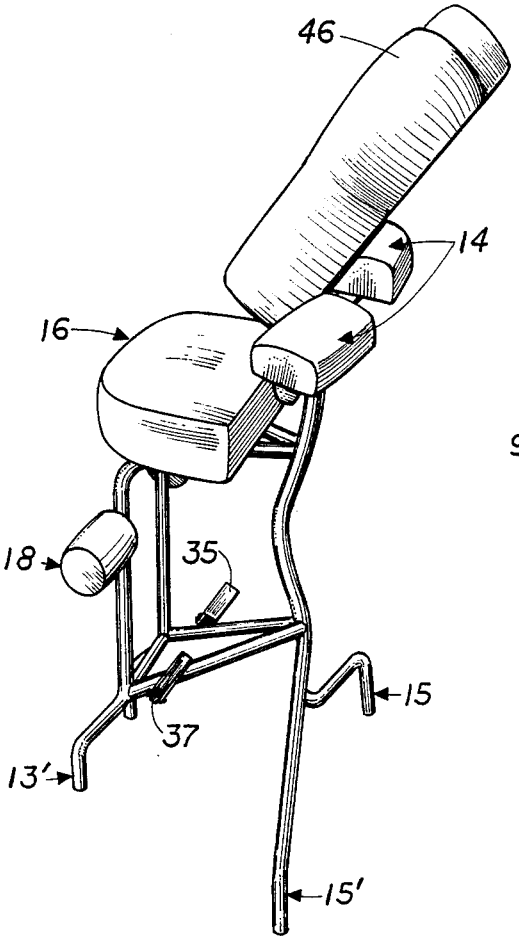
FIG. 10 is a slightly rear perspective view of the right side of the apparatus of this invention.

A variant mount means for the rests, which are designated 180 is shown in FIG. 9. Here the leg posts, 133 have a male threaded distal portion 133A which engages the internal female threads 180B of pipe 180A disposed within said each of said rests.

Mounted at suitable opposed locations on the connecting posts 38, are shoe rest posts 37 having shoe or sole rests 35 mounted thereto. Here each of said sole rests 35 is shown conventionally pivotally mounted, via a pin, a feature that permits the sole rests 35 to be folded upwardly out of the way when not being utilized.

Figure 5:
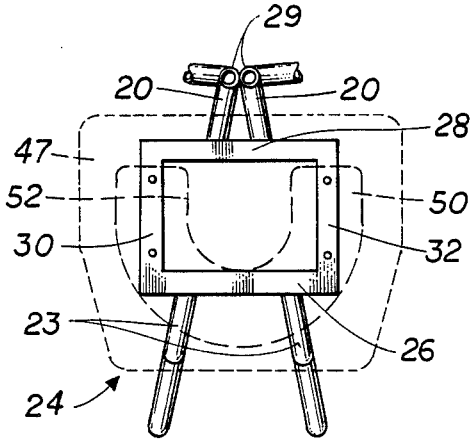
FIG. 5 is a top plan view of the seat support section of the superstructure of this apparatus.

The discussion now turns to FIG. 5 for a description of the boxlike seat frame or seat support 24. This structure may for example be formed from four square tube sections; namely, a front section 26, a rear section similarly sized and spaced and parallel thereto 28; a left side section 30 and a right side section 32 spaced from 30 similarly sized and parallel thereto. Both 30 and 32 are normal to the front and rear sections.

A pair of spring retainer plates 34, 34' are welded or otherwise axially secured to about the middle of side sections 30, 32 at least one coil spring 36, has its lower end conventionally mounted to each plate 34, 34', via an aperture not seen. These lower ends may be welded if desired. The upper ends of each of said springs is conventionally mounted to the underside of seat plate 50. See also FIG. 13.

Figure 13:
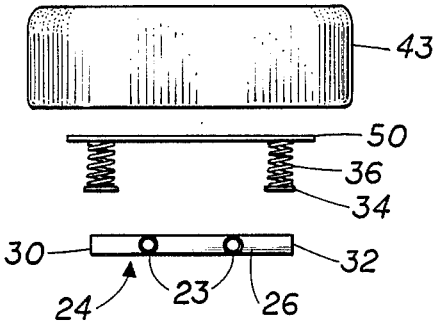
FIG. 13 is a front elevational view of the position of the invention shown in FIG. 5.

Preferably as shown 3 coil springs are employed on each side, and seat plate 50 has a cut out 52, such that during periods of use, the seat cushion 43, which is bolted to seat plate 50, and shown in FIG. 13, can be tilted slightly forward by the pressure of the user's thigh muscles, without interfering with or impacting other structural members of this apparatus. Connector plates 20, (see FIG. 5), which may be tubing or square tubing or flat stock, angularly connect the seat support 24 to the vertical sections 29 as be being welded or adhesed to both, to provide further stability.

Figure 7:
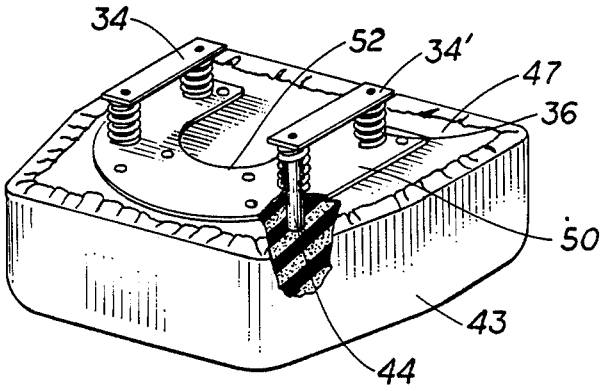
FIG. 7 is a bottom perspective view of the seat block of this apparatus.

FIG. 7 is a bottom perspective view of seat portion 16. This portion includes a seat plate 47, made of wood or metal upon which is conventionally attached an upholstered seat cushion 43. A pair of aligned tubular members, not seen may depend from said plate 47 into the cushion 43. These tubular members align with the spring retainer plates 34 aforesaid, and are of a diameter to receive both of said respective coil springs. An optional spring retainer means 45, may be provided within said tubular members to lock said seat to said seat support frame 24.

Figure 8:
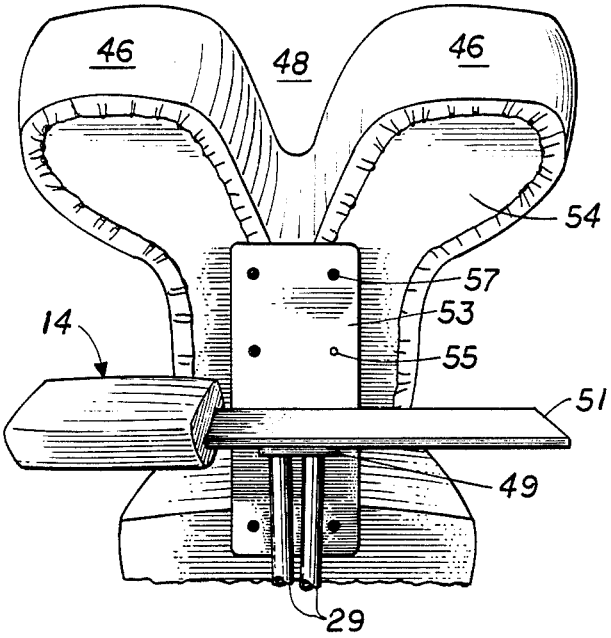
FIG. 8 is a closeup rear perspective view of a part of the head-chest portion of this invention, namely the supporting structure.

FIG. 8 is a closeup rear perspective view of the headchest portion 12's supporting structure. Here third vertical section tubes 29 as previously discussed are seen to terminate in a normally disposed flat stock gusset 49 which may be welded or adhesed to each of said tubes upper terminus. Mounted upon said gusset 49 is an arm bar 51 adapted for the reception of each of the arm rests 14, per FIG. 1. Arm bar 51 may be set into the arm rests 14 inward end or the arm rests, such as of foam rubber, as shown here, may be disposed upon the arm bar 51 as may be desired. Back mount plate 53 which is to be connected to the back plate 54 of portion 12, is attached to one or both of said gusset 49 and said arm bar 51. Optionally, depending upon the pitch, it may also be secured to tubes 29 for extra stability. In addition if desired, said back mount plate 53 may also be attached to the seat cushion 43 by means readily understood by skilled artisans.

Back cushion 42 includes a back plate 53 mounted thereto.

Back mount plate 53 includes a plurality of throughbores 55, each of which receives a bolt 57 for disposition within aligned bores 56, not seen, of the back plate 54 of said back cushion 42. (It is again pointed out that the term back cushion 42 is really a misnomer in view of the desired seating position per FIG. 11. However like any chair, this one can also be used conventionally.)

Returning now to FIG. 1, it is seen that the back cushion 42 has a main section from which extend a pair of diverging upper ears 46 with a generally V-shaped space 48 therebetween. The space 48 is to permit the user of the chair to see the project upon which he or she is working, as per FIG. 11. The cushion 42 is of conventional construction such as being of urethane foam covered with a vinyl or other upholstery material stapled or otherwise attached to back plate 54.

The arm rests 14 may be constructed in like fashion of upholstered urethane foam disposed upon a wood plate (not seen).

Figure 6:
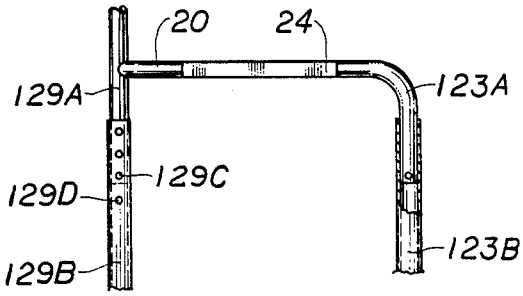
FIG. 6 is a side elevational view illustrating a variant in the superstructure of this apparatus.

Reference is now made to FIG. 6. This figure illustrates a variant in the construction of the superstructure. As is seen in FIGS. 1, 2, and 11 and several others, the apparatus of this invention is intended to be about bar stool high, i.e. the user's feet do not hit the ground. It is however contemplated that the seat of this apparatus could be elevatable. Thus as is seen in FIG. 6, tubes 29 have been replaced by a pair of nestable telescoping tubular elements 129A and 129B. The movable detent 129C that can rest in any of several apertures 129D is seen at rest in a typical location. Such a spring loaded detent that can reside in a plurality of spaced apertures is a conventional telescopic leg mechanism, and as such further amplification and details are not needed. A similar mechanism is to be employed with the seat joiners 23, here designated 123A and 123B for the two parts thereof. For ease and convenience only one such seat joiner 23 and one vertical tube 29 have been shown replaced by telescoping sections 123A & B in this figure. In addition the detent and various apertures have also been omitted in 123B since the same construction would be employed Obviously other telescoping mechanisms such as camlock twistable leg sections such as are used with camera tripods could be adopted for use herein.

USE AND OPERATION

As has been alluded to previously, the user of the chair of this invention, faces the head-chest portion or what would normally be designated the seat back. Thus user 80 as seen in FIG. 11 has her hands and forearm 81 extended in front of her to simulate typing on a keyboard Her elbows 82 are in a position to be supported by arm rests 14 if desired. Her buttocks 85 are slightly elevated off the cushion 43. The thighs 86, knee 87 and lower leg 88 are bent to a V configuration to permit her ankles 89 to be supported by ankle rests 18 previously described.

An alternative seating pattern for doing art work, electrical assembly etc. is depicted in FIG. 12. Here her elbow area 82 is in the vicinity of the arm rests 14, while the soles of her shoes 91 are disposed upon the shoe rests 35. In both positions the body weight is distributed to permit extended periods of time at work without a break being necessary due to physical fatigue.

It is seen that I have provided a comfort chair that can be utilized in both conventional seating posture as well as in the specialized modes depicted herein. It is readily seen that there is no criticality in the construction of the cushions, arm rests and ankle rests as described herein. Other modes of construction for these elements will be apparent to those skilled in the art.

Since certain changes may be made in the above apparatus without departing from the scope of the invention herein involved, it is intended that all matter contained in the above description and shown in the accompanying drawings shall be interpreted as illustrative and not in a limiting sense.

I claim:

1. A comfort chair for use at computer terminals, which chair has no back and which comprises:

a. a superstructure, b. a seat portion, c. a head-chest portion which is faced by a user, each of said seat portion and said head-chest portion being supported by the superstructure and each being spaced from the other portion on said superstructure, said superstructure formed from a plurality of interconnected tubes comprising a pair of spaced front legs and a pair of spaced rear legs, said front legs being connected to said rear legs by a pair of rearwardly converging upwardly directed connecting posts and by a pair of curved seat joiner tubes;

a pair of leg bars, one of which extends outwardly from each of said front legs, and wherein the seat portion is mounted upon said seat joiner tubes and wherein the front legs each have a generally vertical base section and an upwardly inclined second section commencing therefrom, and a generally vertical third section, said second sections being joined by a horizontal bar, and the spacing between the two front legs is less than the spacing between the two rear legs at their locus of contact with the ground.

2. The comfort chair of claim 1 further including a pair of shoe rest posts, one of which extends outwardly from each of said upwardly directed connecting posts.

3. The comfort chair of claim 2 wherein said shoe rest posts are pivotally mounted.

4. The comfort chair of claim 1 wherein the rear legs each include a generally vertical first section, connected at one end to an inwardly directed S-curved second section each of the latter being connected at their respective other end to a vertically directed third section, the two third sections being closely spaced from each other.

5. The comfort chair of claim 4 wherein the third vertical sections of said rear legs terminate at a horizontally disposed flat gusset attached thereto, and mounted upon said gusset is an arm bar, also disposed horizontally and normal to the extension of which is said third sections and adapted for the reception of arm rests.

6. The comfort chair of claim 5 wherein arm rests are disposed upon the arm bar.

7. The comfort chair of claim 5 wherein a back mount plate is attached to at least one of said gusset and said arm bar and said vertical third section of said rear legs, said head-chest portion being mounted on said back mount plate.

8. The comfort chair of claim 7 wherein the head-chest portion comprises a back plate having a back cushion thereon, which back plate is attached to said back mount plate.

9. The comfort chair of claim 8 wherein the back cushion has a main section from which extend a pair of diverging upper ears with a generally V-shaped space therebetween.

10. The comfort chair of claim 9 wherein the seat portion comprises a pair of spaced spring retainer plates resiliently mounted to a seat plate, upon which is seat cushion.

11. The comfort chair of claim 1 further including an arm bar with arm rests mounted thereto and forming part of said superstructure.

12. The comfort chair of claim 11 wherein a back mount plate is secured to said arm bar and said head-chest portion is mounted on said back mount plate.

13. The comfort chair of claim 12 wherein the head-chest portion comprises a back plate having a back cushion thereon, which back plate is attached to said back mount plate.

14. The comfort chair of claim 13 wherein the back cushion has a main section from extend a pair of diverging upper ears with a generally V-shaped space therebetween.

15. The comfort chair of claim 14 wherein the seat portion comprises a pair of spaced spring retainer plates resiliently mounted to a seat plate, upon which is a seat cushion.

16. The comfort chair of claim 12 wherein the front legs and the rear legs are of a telescopic construction.

17. The comfort chair of claim 1 wherein the front legs and the rear legs are of a telescopic construction.

18. The comfort chair of claim 1 wherein the seat portion is springingly secured to said seat joiner tubes.

19. The comfort chair of claim 1 wherein the seat portion comprises a pair of spaced spring retainer plates resiliently mounted to a seat plate, upon which is a seat cushion.

* * * * *